US010614743B2

(12) United States Patent
Kim et al.

(10) Patent No.: US 10,614,743 B2
(45) Date of Patent: Apr. 7, 2020

(54) DISPLAY APPARATUS AND A METHOD OF DRIVING THE SAME

(71) Applicant: SAMSUNG DISPLAY CO., LTD., Yongin-si, Gyeonggi-Do (KR)

(72) Inventors: Jong-Tae Kim, Seoul (KR); Sucheol Kang, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 177 days.

(21) Appl. No.: 15/377,042

(22) Filed: Dec. 13, 2016

(65) Prior Publication Data

US 2017/0193890 A1 Jul. 6, 2017

(30) Foreign Application Priority Data

Dec. 30, 2015 (KR) ..... 10-2015-0189804

(51) Int. Cl.

*G09G 5/00* (2006.01)
*G09G 3/36* (2006.01)
*G09G 3/20* (2006.01)

(52) U.S. Cl.

CPC ... *G09G 3/2092* (2013.01); *G09G 2310/0267* (2013.01); *G09G 2310/0275* (2013.01); *G09G 2310/061* (2013.01); *G09G 2310/08* (2013.01); *G09G 2330/021* (2013.01); *G09G 2360/18* (2013.01)

(58) Field of Classification Search

CPC .. G09G 5/00; G09G 5/02; G09G 5/10; G09G 3/20; G09G 3/30; G09G 3/36; H04N 7/01; H04N 9/12; H04N 9/74; H04N 5/14; H04N 5/91; H04N 5/228; H04N 5/00; H04N 13/04

See application file for complete search history.

(56) References Cited

U.S. PATENT DOCUMENTS

2006/0077290 A1* 4/2006 Chung ..... G09G 5/006 348/441
2007/0195026 A1* 8/2007 Hagood ..... G02B 26/02 345/85
2010/0039557 A1* 2/2010 Mori ..... G09G 3/20 348/459
2011/0292187 A1* 12/2011 Chen ..... H04N 13/341 348/51
2012/0044252 A1* 2/2012 Kamimura ..... G09G 5/006 345/530
2012/0120067 A1* 5/2012 Kim ..... G02B 27/2264 345/419

(Continued)

*Primary Examiner* — Chanh D Nguyen
*Assistant Examiner* — Nguyen H Truong
(74) *Attorney, Agent, or Firm* — F. Chau & Associates, LLC

(57) ABSTRACT

A display apparatus includes a timing controller configured to generate a display synchronization signal and a standby enable signal during a moving image mode, wherein the display synchronization signal is generated using an original synchronization signal and the standby enable signal corresponds to a preset frame period of the display synchronization signal. The display apparatus includes a data driver to block a data voltage from being provided to a data line in response to the standby enable signal, and a gate clock generator configured to block a gate clock signal from being outputted in response to the standby enable signal.

17 Claims, 8 Drawing Sheets

(56) References Cited

U.S. PATENT DOCUMENTS

| | | | | |
|---|---|---|---|---|
| 2013/0082999 | A1* | 4/2013 | Ahn | G09G 3/003<br>345/212 |
| 2014/0313236 | A1 | 10/2014 | Jang et al. | |
| 2017/0352318 | A1* | 12/2017 | Koyama | G09G 3/3696 |

* cited by examiner

<COMPARATIVE EXAMPLE EMBODIMENT>

<EXEMPLARY EMBODIMENT>

DISPLAY APPARATUS AND A METHOD OF DRIVING THE SAME

CROSS-REFERENCE TO RELATED APPLICATION

This application claims priority under 35 U.S.C. § 119 to Korean Patent Application No. 10-2015-0189804 filed on Dec. 30, 2015, the disclosure of which is incorporated by reference herein in its entirety.

TECHNICAL FIELD

Exemplary embodiments of the inventive concept relate to a display apparatus and a method of driving the display apparatus.

DESCRIPTION OF THE RELATED ART

High resolution display devices are now being provided with many mobile phones. Generally, a high resolution display device receives an image signal from a host through a display driver integrated circuit to display the image signal. When the display device receives a still image from the host, power consumption occurs in a memory access and an interface of the host.

Recently, a new version of an embedded display port has been developed. The embedded display port may hereinafter be referred to as the 'eDP' standard. The eDP standard is an interface standard corresponding to a display port interface designed for devices equipped with a display such as a lap-top computer, a tablet personal computer (PC), a net book, and an all-in-one desktop PC.

Generally, a driving frequency of the display device may be higher than a driving frequency of an input signal received from a host, and thus, power consumption of the display device may be increased. To decrease this power consumption, a panel self-refresh (PSR) technology may be used.

The PSR technology may display an image while minimizing power consumption using a memory installed in a display, for example.

SUMMARY

According to an exemplary embodiment of the inventive concept, there is provided a display apparatus. The display apparatus includes a display panel comprising a data line and a gate line, wherein the display panel is configured to display an image. The display apparatus also includes a timing controller configured to generate a display synchronization signal and a standby enable signal during a moving image mode, wherein the display synchronization signal is generated using an original synchronization signal and the standby enable signal corresponds to a preset frame period of the display synchronization signal. The display apparatus further includes a data driver configured to provide the data line with a data voltage corresponding to a moving image in response to the display synchronization signal and to block the data voltage from being provided to the data line in response to the standby enable signal, a gate clock generator configured to output a gate clock signal in response to the display synchronization signal and to block the gate clock signal from being outputted in response to the standby enable signal, and a gate driver configured to generate a gate signal in response to the gate clock signal and to output the gate signal to the gate line.

In an exemplary embodiment of the inventive concept, the display apparatus may further include a frame buffer configured to store an image data frame of the moving image in the moving image mode.

In an exemplary embodiment of the inventive concept, the timing controller may be configured to receive an image data frame of the moving image and a black data frame, and the preset frame period corresponds to the black data frame.

In an exemplary embodiment of the inventive concept, a driving frequency of the original synchronization signal may be equal to that of the display synchronization signal.

In an exemplary embodiment of the inventive concept, the driving frequency of the original synchronization signal may be about 48 Hz.

In an exemplary embodiment of the inventive concept, a driving frequency of the original synchronization signal may be lower than that of the display synchronization signal.

In an exemplary embodiment of the inventive concept, a single frame period of the original synchronization signal may include at least one preset frame period of the display synchronization signal.

In an exemplary embodiment of the inventive concept, two sequential frame periods of the original synchronization signal may include at least three preset frame periods of the display synchronization signal.

In an exemplary embodiment of the inventive concept, the driving frequency of the original synchronization signal may be about 24 Hz and the driving frequency of display synchronization signal is about 60 Hz.

According to an exemplary embodiment of the inventive concept, there is provided a display apparatus. The display apparatus includes a display panel comprising a data line and a gate line and displaying an image with a high driving frequency, a timing controller configured to receive an image data frame corresponding to a moving image and a black data frame and to generate a display synchronization signal for the image data frame and a standby enable signal for the black data frame in a moving image mode, a data driver configured to provide the data line with a data voltage corresponding to the image data frame in response to the display synchronization signal and to block the data voltage from being outputted to the data line in response to the standby enable signal, a gate clock generator configured to output a gate clock signal in response to the display synchronization signal and to block the gate clock signal from being outputted in response to the standby enable signal, and a gate driver configured to generate a gate signal in response to the gate clock signal and to output the gate signal to the gate line.

In an exemplary embodiment of the inventive concept, the standby enable signal may have a first level corresponding to the image data frame and a second level corresponding to the black data frame.

According to an exemplary embodiment of the inventive concept, there is provided a method of driving a display apparatus which comprises a data line and a gate line. The method includes generating a display synchronization signal using an original synchronization signal in a moving image mode, generating a standby enable signal corresponding to a preset frame period of the display synchronization signal, blocking a data voltage from being provided to the data line in response to the standby enable signal and blocking a gate clock signal from being outputted in response to the standby enable signal.

In an exemplary embodiment of the inventive concept, the method may further include receiving an image data frame corresponding to a moving image and a black data frame, wherein the preset frame period may correspond to the black data frame.

In an exemplary embodiment of the inventive concept, a driving frequency of the original synchronization signal may be equal to that of the display synchronization signal.

In an exemplary embodiment of the inventive concept, the driving frequency of the original synchronization signal is about 48 Hz.

In an exemplary embodiment of the inventive concept, a driving frequency of the original synchronization signal may be lower than that of the display synchronization signal.

In an exemplary embodiment of the inventive concept, a single frame period of the original synchronization signal may include at least one preset frame period of the display synchronization signal.

In an exemplary embodiment of the inventive concept, two sequential frame periods of the original synchronization signal may include at least three preset frame periods of the display synchronization signal.

In an exemplary embodiment of the inventive concept, the driving frequency of the original synchronization signal is about 24 Hz and the driving frequency of display synchronization signal is about 60 Hz.

According to an exemplary embodiment of the inventive concept, there is provided a method of driving a display apparatus which comprises a data line and a gate line. The method includes receiving an image data frame corresponding to a moving image and a black data frame in a moving image mode, generating a standby enable signal during a frame period corresponding to the black data frame, blocking a data voltage from being provided to the data line in response to the standby enable signal, and blocking a gate clock signal from being outputted in response to the standby enable signal.

BRIEF DESCRIPTION OF THE DRAWINGS

The above and other features of the inventive concept will become more apparent by describing in detail exemplary embodiments thereof with reference to the accompanying drawings, in which.

DETAILED DESCRIPTION OF THE EMBODIMENTS

Hereinafter, exemplary embodiments of the inventive concept will be explained in detail with reference to the accompanying drawings.

Figure 1:
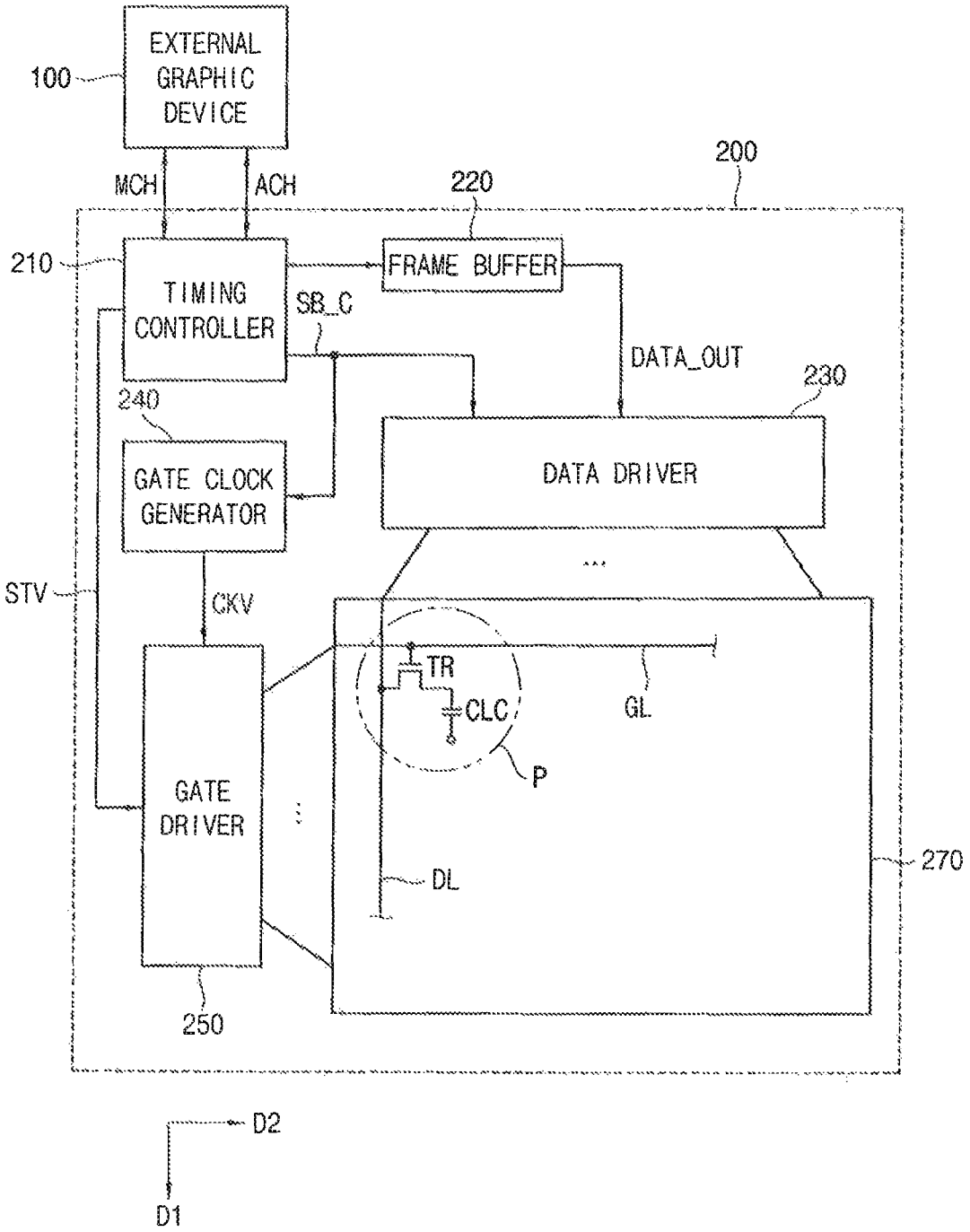
FIG. 1 is a block diagram illustrating a display apparatus according to an exemplary embodiment of the inventive concept.

FIG. 1 is a block diagram illustrating a display apparatus according to an exemplary embodiment of the inventive concept.

Referring to FIG. 1, a display system may include an external graphic device 100 and a display apparatus 200. The external graphic device 100 and the display apparatus 200 may use an interface method such as DP1.2a, DP1.3, eDP1.3, eDP1.4, etc. DP may refer to 'display port' and eDP may refer to 'embedded display port.'

According to the interface method, the external graphic device 100 and the display apparatus 200 may be configured to transmit an image signal, a synchronization signal and a command signal through a main channel MCH and an auxiliary channel ACH. For example, the main channel MCH may be configured to transmit the image signal and the auxiliary channel ACH may be configured to transmit the synchronization signal and the command signal.

The display apparatus 200 may include a timing controller 210, a frame buffer 220, a data driver 230, a gate clock generator 240, a gate driver 250 and a display panel 270.

The timing controller 210 is configured to control operations of the display apparatus 200. The timing controller 210 is configured to receive the image signal through the main channel MCH and to receive an original synchronization signal and a command signal through the auxiliary channel ACH.

The timing controller 210 is configured to generate a display synchronization signal for driving the display apparatus 200 based on the original synchronization signal. The display synchronization signal may include a data synchronization signal for driving the data driver 230 and a gate synchronization signal for driving the gate driver 250. The display synchronization signal may include a data enable signal, a vertical synchronization signal, a horizontal synchronization signal, a dot clock signal, a vertical start signal, etc.

The timing controller 210 is configured to receive a Media Buffer Optimization (MBO) command signal through the main channel MCH. The MBO command signal is used by the timing controller 210 for driving with an MBO mode during a vertical blanking period of the original synchronization signal.

Generally, the MBO mode is a driving mode for decreasing power consumption in a moving image environment. The external graphic device 100 is configured to alternately transmit an image data frame corresponding to the image signal and a black data frame to the display apparatus 200 with a driving frequency of the display apparatus 200. The display apparatus 200 is configured to store the image data frame in a frame buffer, and is configured to display a moving image using the image data frame stored in the frame buffer (e.g., DATA_OUT) during a frame period corresponding to the black data frame. Therefore, the external graphic device 100 is not driven during the frame period corresponding to the black data frame. Rather, only the display apparatus 200 is driven during the frame period corresponding to the black data frame, and thus, power consumption for driving the external graphic device 100 may be decreased.

According to an exemplary embodiment of the inventive concept, while driving with the MBO mode in the moving image environment, the timing controller 210 is configured to drive the display apparatus 200 with a standby mode during the frame period corresponding to the black data frame, and thus, power consumption for driving the external graphic device 100 may be decreased. In the standby mode, the data driver 230 and the gate driver 250 are not driven, for example.

In the MBO mode, the timing controller 210 is configured to generate a display synchronization signal masking an original synchronization signal in a preset frame period corresponding to the black data frame. For example, the display synchronization signal may include a data enable signal. The timing controller 210 is configured to generate a standby enable signal for driving the display apparatus 200 with the standby mode during the frame period corresponding to the black data frame. The timing controller 210 is configured to provide the data driver 230 and the gate clock generator 240 with the standby enable signal.

The frame buffer 220 may be configured to store the image data frame received from the external graphic device 100 in the MBO mode. The frame buffer 220 is configured to provide the data driver 230 with the image data frame (e.g., DATA_OUT) based on a control of the timing controller 210.

The data driver 230 is configured to convert image data of the image data frame into a data voltage and to output the data voltage to a data line of the display panel 270 based on the standby enable signal. For example, the data driver 230 is configured to output the data voltage to the data line in response to a low level of the standby enable signal. However, the data driver 230 is configured not to output the data voltage the data line in response to a high level of the standby enable signal. In other words, the data driver 230 is not driven in response to the high level of the standby enable signal.

The gate clock generator 240 is configured to generate at least one gate clock signal for driving the gate driver 250 in response to the standby enable signal and to provide the gate driver 250 with the least one gate clock signal. The gate clock generator 240 is configured to provide the gate driver 250 with the gate clock signal in response to the low level of the standby enable signal, and to block the gate clock signal from being outputted to the gate driver 250 in response to the high level of the standby enable signal.

The gate driver 250 is configured to generate a gate signal based on the gate control signal and the gate clock signal, and to output the gate signal to the gate line of the display panel 270. The gate driver 250 is configured to output the gate signal to the gate line during a period in which the standby enable signal is at the low level.

However, the gate driver 250 is configured not to be driven during a period in which the standby enable signal is at the high level, and thus, the gate signal is blocked from being outputted to the gate line. In other words, the gate driver 250 is not driven in response to the high level of the standby enable signal.

The display panel 270 may include a plurality of data lines DL, a plurality of gate lines GL and a plurality of pixels P.

The plurality of data lines DL extend in a first direction D1 and are arranged in a second direction D2 crossing the first direction D1. The plurality of gate lines GL extend in the second direction D2 and are arranged in the first direction D1. Each of the plurality of pixels P may include a switch element TR and a liquid crystal capacitor CLC. The switch element TR is connected to a data line DL, a gate line GL and the liquid crystal capacitor CLC. The switch element TR is a transistor, for example.

As described above, according to the present exemplary embodiment, during a frame period corresponding to the black data frame in the MBO mode, the display apparatus 200 drives with the standby mode in which the data driver 230 and the gate driver 250 are not driven. While driving with the MBO mode in the moving image environment, power consumption of the display apparatus 200 as well as power consumption of the external graphic device 100 may be decreased.

Figure 2:
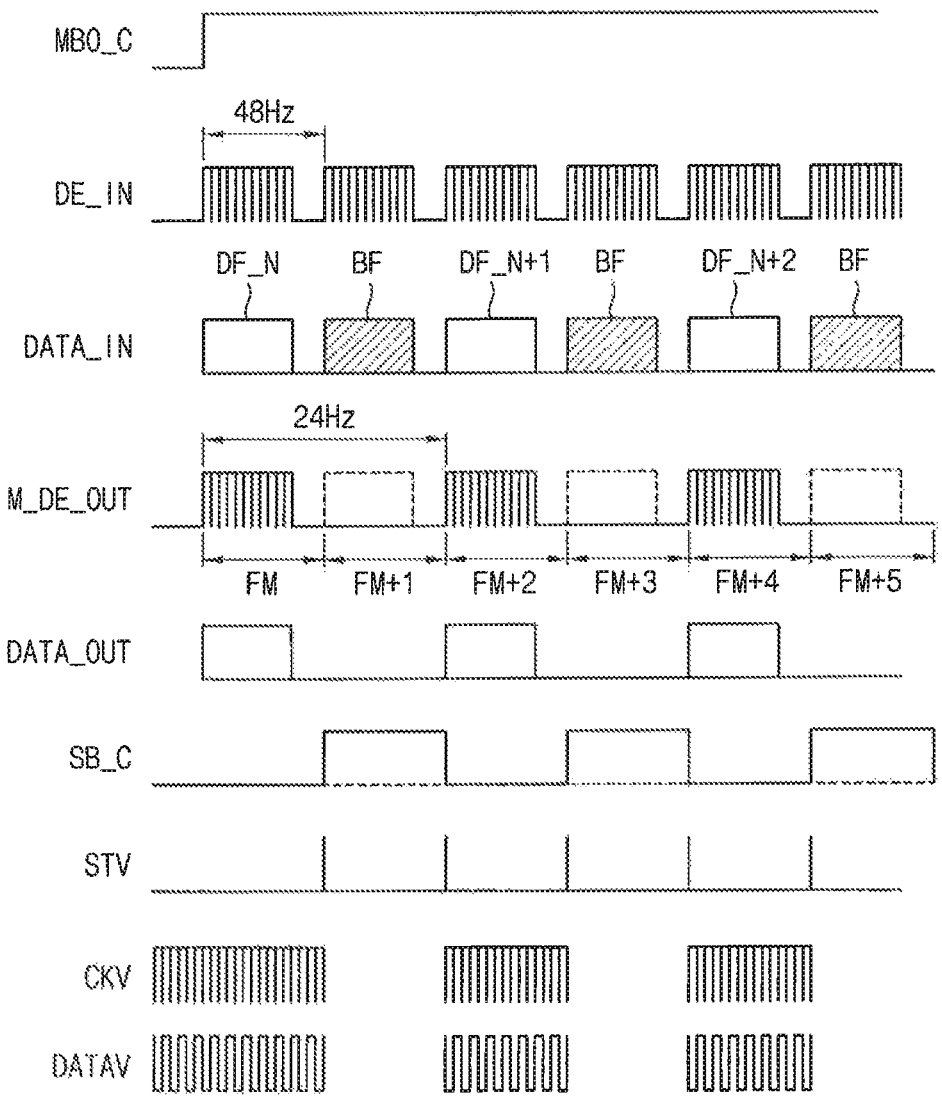
FIG. 2 is a waveform diagram illustrating a method of driving a display apparatus according to an exemplary embodiment of the inventive concept.

FIG. 2 is a waveform diagram illustrating a method of driving a display apparatus according to an exemplary embodiment of the inventive concept.

Referring to FIGS. 1 and 2, when the MBO mode is started, the external graphic device 100 is configured to transmit an MBO command signal MBO_C to the display apparatus 200. In addition, the external graphic device 100 is configured to convert a moving image signal having a driving frequency of about 24 Hz into a moving image signal having a driving frequency of about 48 Hz to correspond to that of the display apparatus 200. The external graphic device 100 is configured to transmit the moving image signal having the driving frequency of about 48 Hz to the display apparatus 200. The moving image signal having the driving frequency of about 48 Hz may include an image data frame DF_N corresponding to the moving image and a low-grayscale data frame BF corresponding to a low-grayscale image. Hereinafter, the low-grayscale data frame BF may be referred to as a black data frame BF. The image data frame DF_N and the black data frame BF may be alternately transmitted to the display apparatus 200. In addition, the external graphic device 100 is configured to transmit a data enable signal DE_IN having the driving frequency of about 48 Hz to the display apparatus 200.

The timing controller 210 of the display apparatus 200 is configured to mask a data enable signal in a preset frame period of the 48 Hz data enable signal DE_IN corresponding to the black data frame BF and to generate a masked data enable signal M_DE_OUT.

The timing controller 210 is configured to generate a standby enable signal SB_C based on the image data frame DF_N and the black data frame BF. The standby enable signal SB_C may have a low level corresponding to the image data frame DF_N and a high level corresponding to the black data frame BF.

The timing controller 210 is configured to provide the data driver 230 and the gate clock generator 240 with the standby enable signal SB_C, respectively.

The timing controller 210 is configured to store the image data frame DF_N corresponding to the moving image signal in response to the MBO command signal MBO_C at the frame buffer 220. The frame buffer 220 may store the image data frames DF_N, DF_N+1 and DF_N+2 by a frame unit.

The timing controller 210 is configured to provide the data driver 230 with the image data frame DF_N stored in the frame buffer 220 based on the masked data enable signal M_DE_OUT.

The timing controller 210 is configured to generate a vertical start signal STV, which is a gate control signal, and to provide the gate driver 250 with the vertical start signal STV.

The gate clock generator 240 is configured to generate a gate clock signal CKV. The gate clock generator 240 is configured to control an output of the gate clock signal CKV in response to the standby enable signal SB_C. The gate clock generator 240 is configured to output the gate clock signal CKV to the gate driver 250 during frame periods FM, FM+2 and FM+4 in which the standby enable signal SB_C is at the low level. The gate clock generator 240 is configured to block the gate clock signal CKV from being outputted to the gate driver 250 during preset frame periods FM+1, FM+3 and FM+5 corresponding to the black data frames in which the standby enable signal SB_C is at the high level.

The data driver 230 is configured to convert image data of the image data frame DF_N into a data voltage. The data driver 230 is configured to output the data voltage to the data line in response to the low level of the standby enable signal SB_C. However, the data driver 230 is configured not to output the data voltage to the data line in response to the high level of the standby enable signal SB_C during the preset frame periods FM+1, FM+3 and FM+5 corresponding to the black data frame. In other words, the data driver 230 is not driven in response to the low level of the standby enable signal SB_C during the preset frame periods, e.g., FM+1, FM+3 and FM+5 corresponding to the black data frame.

For example, the data driver 230 is configured to output the data voltage of the N-th image data frame DF_N to the data line during an M-th frame FM of 48 Hz and not to output the data voltage of the N-th image data frame DF_N to the data line during an (M+1)-th frame FM+1 of 48 Hz. The data driver 230 is configured to output the data voltage of the (N+1)-th image data frame DF_N+1 to the data line during an (M+2)-th frame FM+2 of 48 Hz and not to output the data voltage of the (N+1)-th image data frame DF_N+1 to the data line during an (M+3)-th frame FM+3 of 48 Hz. The data driver 230 is configured to output the data voltage of the (N+2)-th image data frame DF_N+2 to the data line during an (M+4)-th frame FM+4 of 48 Hz and not to output the data voltage of the (N+2)-th image data frame DF_N+2 to the data line during an (M+5)-th frame FM+5 of 48 Hz.

The gate driver 250 is configured to generate a gate signal based on the vertical start signal STV and the gate clock signal CKV. The gate driver 250 is configured to output the gate signal to the gate line during a frame period in which the standby enable signal SB_C is at the low level, and not to output the gate signal to the gate line during a preset frame period in which the standby enable signal SB_C is at the high level. In other words, the gate driver 250 does not receive the gate clock signal CKV during the preset frame period, and thus, is not driven during the preset frame period.

For example, the gate driver 250 is configured to output the gate signal to the gate line during the M-th frame FM of 48 Hz and not to output the gate signal to the gate line during the (M+1)-th frame FM+1 of 48 Hz. The gate driver 250 is configured to output the gate signal to the gate line during the (M+2)-th frame FM+2 of 48 Hz and not to output the gate signal to the gate line during the (M+3)-th frame FM+3 of 48 Hz. The gate driver 250 is configured to output the gate signal to the gate line during the (M+4)-th frame FM+4 of 48 Hz and not to output the gate signal to the gate line during the (M+5)-th frame FM+5 of 48 Hz.

Therefore, during a frame period corresponding to the black data frame in the MBO mode, the display apparatus 200 drives with the standby mode in which the data driver 230 and the gate drive 250 are not driven.

According to the present exemplary embodiment, while driving with the MBO mode in the moving image environment, power consumption of the display apparatus 200 as well as power consumption of the external graphic device 100 may be decreased.

Figure 3:
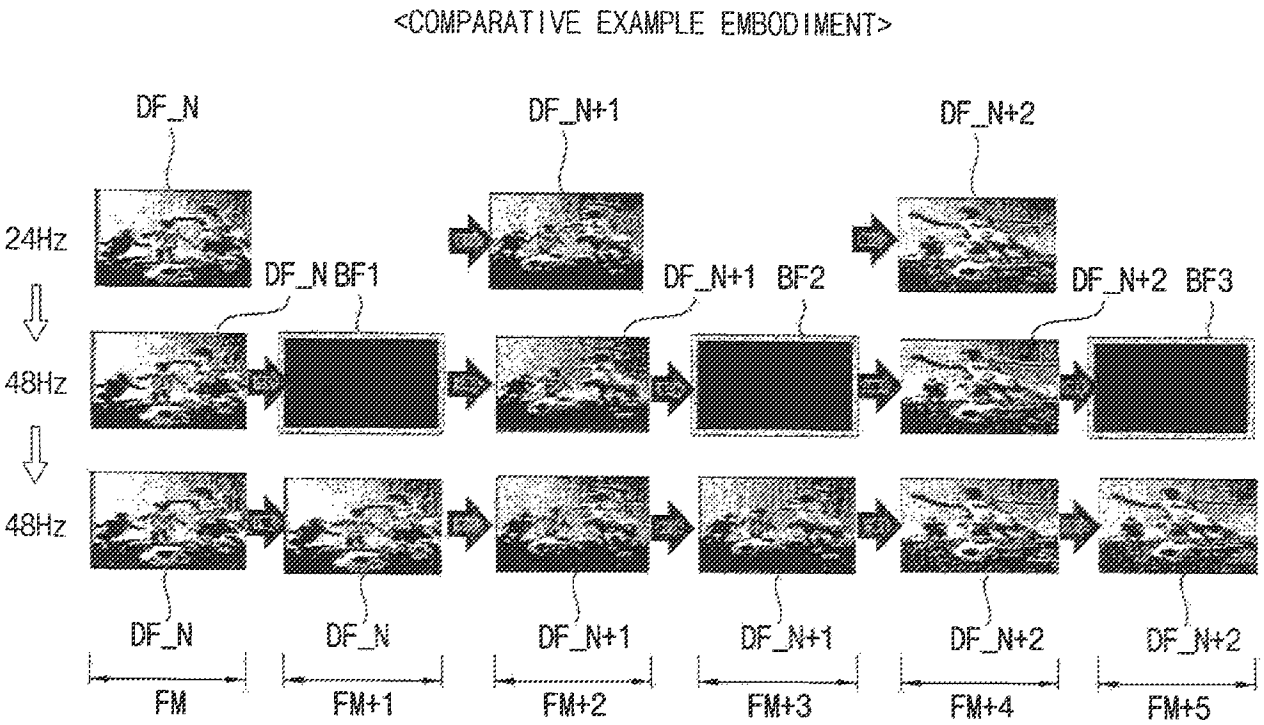
FIG. 3 is a diagram illustrating a method of driving a display apparatus according to a comparative example embodiment.

FIG. 3 is a diagram illustrating a method of driving a display apparatus according to a comparative example embodiment.

Referring to FIGS. 1 and 3, according to a comparative example embodiment, the external graphic device 100 is configured to receive image data frames DF_N, DF_N+1 and DF_N+2 which are included in a moving image signal having a driving frequency of 24 Hz.

The external graphic device 100 is configured to determine whether a received image signal corresponds to the moving image signal. When the image signal corresponds to the moving image signal, the external graphic device 100 is configured to convert the moving image signal having the driving frequency of 24 Hz into the moving image signal having the driving frequency of 48 Hz and to transmit the 48 Hz moving image signal to the display apparatus 200 for driving the display apparatus 200 with the MBO mode. The moving image signal of 48 Hz may include an image data frame and a black data frame, which are alternate each other. For example, the moving image signal of 48 Hz includes the image data frames DF_N, DF_N+1 and DF_N+2 respectively corresponding to the image data frames DF_N, DF_N+1 and DF_N+2 of 24 Hz and black data frames BF1, BF2 and BF3.

The external graphic device 100 is configured to alternately transmit the image data frames DF_N, DF_N+1 and DF_N+2 and the black data frames BF1, BF2 and BF3 to the display apparatus 200.

The display apparatus 200 is configured to display an N-th image data frame DF_N on the display apparatus 200 during an M-th frame FM of 48 Hz, and to repetitively display the N-th image data frame DF_N stored in the frame buffer 220 on the display apparatus 200 during an (M+1)-th frame F M+1 of 48 Hz corresponding to a first black data frame BF1.

The display apparatus 200 is configured to display an (N+1)-th image data frame DF_N+1 on the display apparatus 200 during an (M+2)-th frame FM+2 of 48 Hz, and to repetitively display the (N+1)-th image data frame DF_N+1 stored in the frame buffer 220 on the display apparatus 200 during an (M+3)-th frame FM+3 of 48 Hz corresponding to a second black data frame BF2.

The display apparatus 200 is configured to display an (N+2)-th image data frame DF_N+2 on the display apparatus 200 during an (M+4)-th frame FM+4 of 48 Hz, and to repetitively display the (N+2)-th image data frame DF_N+2 stored in the frame buffer 220 on the display apparatus 200 during an (M+5)-th frame FM+5 of 48 Hz corresponding to a third black data frame BF3.

As described above, according to the comparative example embodiment, during the frame period corresponding to the black data frame, the external graphic device 100 is not driven, and only the display apparatus 200 is driven. Thus, power consumption for driving the external graphic device 100 may be decreased.

Figure 4:
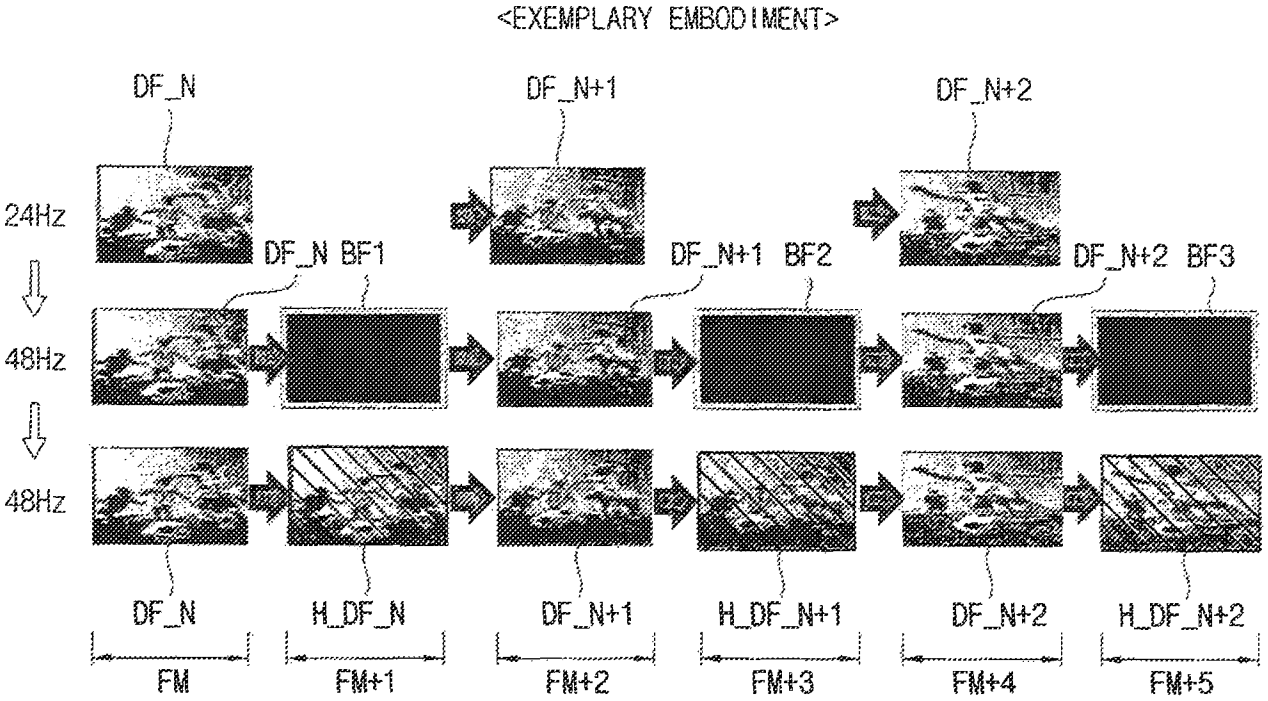
FIG. 4 is a diagram illustrating a method of driving a display apparatus according to an exemplary embodiment of the inventive concept.

FIG. 4 is a diagram illustrating a method of driving a display apparatus according to an exemplary embodiment of the inventive concept.

Referring to FIGS. 1 and 4, according to the present exemplary embodiment, the external graphic device 100 is configured to receive image data frames DF_N, DF_N+1, DF_N+2 which are included in a moving image signal having a driving frequency of about 24 Hz.

The external graphic device 100 is configured to determine whether a received image signal corresponds to the moving image signal. When the image signal corresponds to the moving image signal, the external graphic device 100 is configured to convert the moving image signal having the driving frequency of about 24 Hz into the moving image signal having the driving frequency of about 48 Hz and to transmit the 48 Hz moving image signal to the display apparatus 200 for driving the display apparatus 200 with the MBO mode. The moving image signal of about 48 Hz may include an image data frame and a black data frame, which are alternate each other. For example, the moving image signal of about 48 Hz includes the image data frames DF_N, DF_N+1 and DF_N+2 respectively corresponding to the image data frames DF_N, DF_N+1 and DF_N+2 of 24 Hz and black data frames BF1, BF2 and BF3 between the image data frames DF_N, DF_N+1 and DF_N+2.

The external graphic device 100 is configured to alternately transmit the image data frames DF_N, DF_N+1 and DF_N+2 and the black data frames BF1, BF2 and BF3 to the display apparatus 200.

The display apparatus 200 is configured to display an N-th image data frame DF_N on the display apparatus 200 during an M-th frame FM of about 48 Hz. The display apparatus 200 is also configured to hold a frame image of the N-th image data frame DF_N that was displayed on the display apparatus 200 in the M-th frame FM during an (M+1)-th frame FM+1 of about 48 Hz corresponding to a first black data frame BF1 (H_DF_N). In other words, the frame image of the frame FM remains and is displayed in the next frame FM+1. The display apparatus 200 is configured to drive with the standby mode during the (M+1)-th frame FM+1 of about 48 Hz.

The display apparatus 200 is configured to display an (N+1)-th image data frame DF_N+1 on the display apparatus 200 during an (M+2)-th frame FM+2 of 48 Hz.

The display apparatus 200 is also configured to hold a frame image of the (N+1)-th image data frame DF_N+1 that was displayed on the display apparatus 200 in the (M+2)-th frame FM+2 during an (M+3)-th frame FM+3 of 48 Hz corresponding to a second black data frame BF2 (H_DF_N+1). The display apparatus 200 is configured to drive with the standby mode during the (M+3)-th frame FM+3 of about 48 Hz.

The display apparatus 200 is configured to display an (N+2)-th image data frame DF_N+2 on the display apparatus 200 during an (M+4)-th frame FM+4 of 48 Hz. The display apparatus 200 is also configured to hold a frame image of the (N+2)-th image data frame DF_N+2 that was displayed on the display apparatus 200 in the (M+4)-th frame FM+4 during an (M+5)-th frame FM+5 of 48 Hz corresponding to a third black data frame BF3 (H_DF_N+2). The display apparatus 200 is configured to drive with the standby mode during the (M+5)-th frame FM+5 of about 48 Hz.

As described above, according to the present exemplary embodiment, during the frame period corresponding to the black data frame, the external graphic device 100 and display apparatus 200 are not driven. Thus, power consumption for driving the display apparatus 200 as well as power consumption for driving the external graphic device 100 may be decreased.

Figure 5:
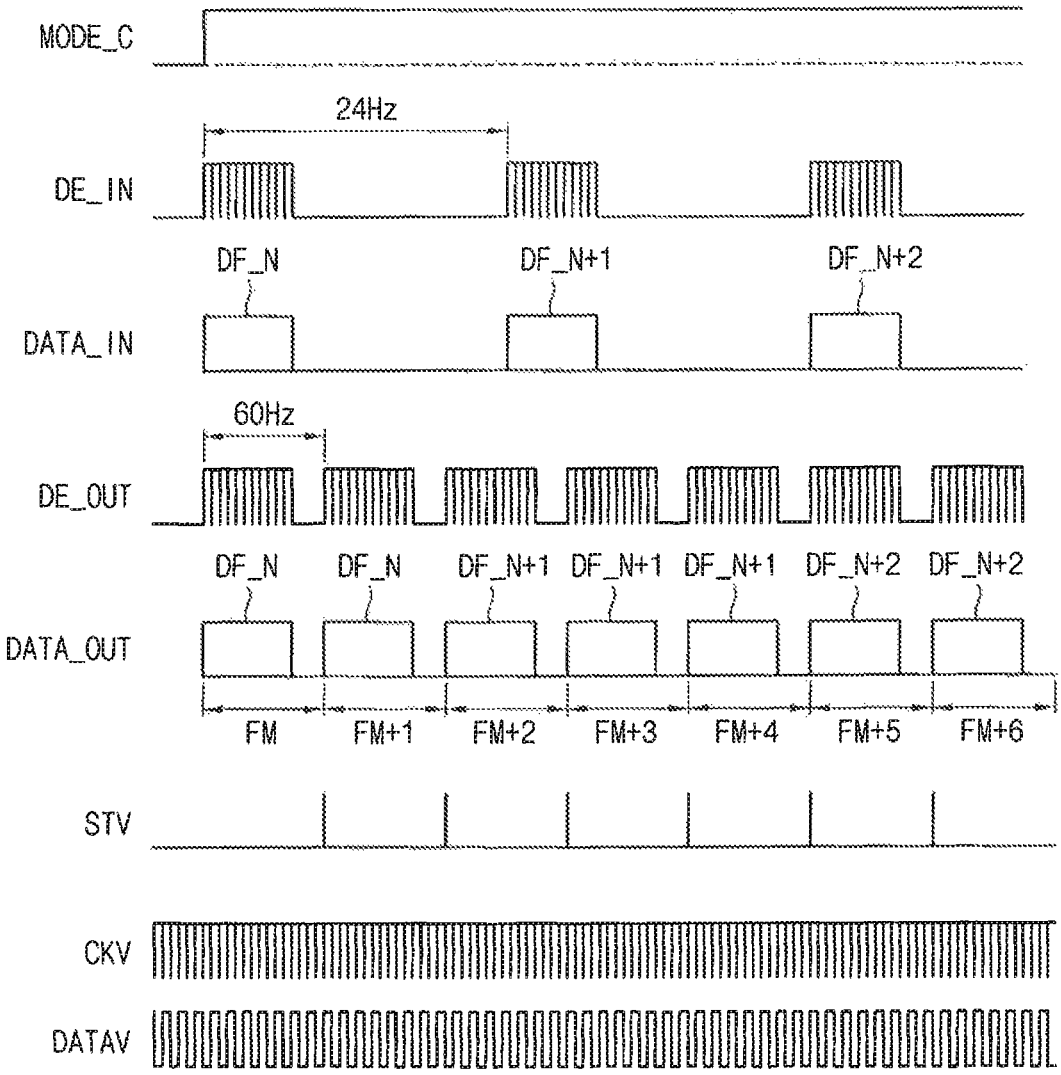
FIG. 5 is a waveform diagram illustrating a method of driving a display apparatus according to a comparative example embodiment.
Figure 6:
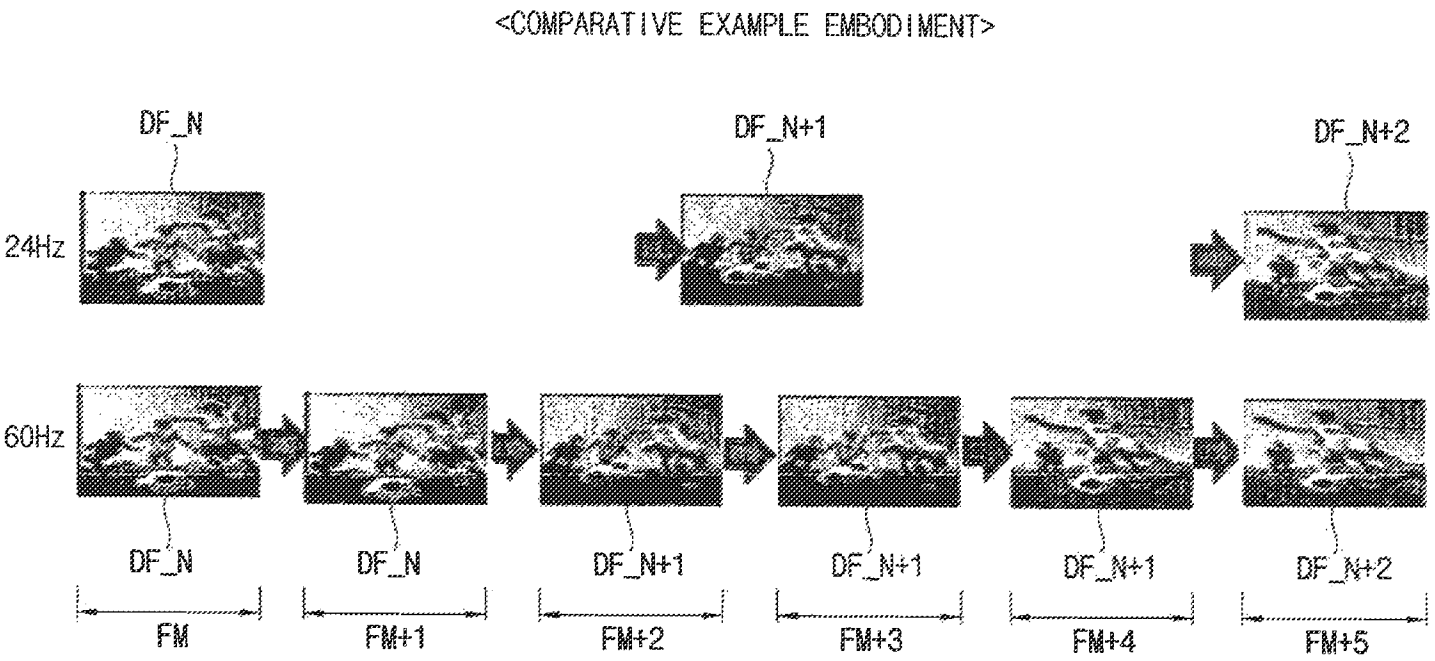
FIG. 6 is a diagram illustrating a method of driving a display apparatus according to a comparative example embodiment.

FIG. 5 is a waveform diagram illustrating a method of driving a display apparatus according to a comparative example embodiment. FIG. 6 is a diagram illustrating a method of driving a display apparatus according to a comparative example embodiment.

Referring to FIGS. 1, 5 and 6, according to the comparative example embodiment, the external graphic device 100 is configured to transmit image data frames DF_N, DF_N+1, DF_N+2 which are included in a moving image signal having a driving frequency of 24 Hz to the display apparatus 200 in a moving image environment. The external graphic device 100 is configured to transmit a data enable signal DE_IN and a moving-image mode signal MODE_C which are original synchronization signals each having a driving frequency of 24 Hz.

The timing controller 210 of the display apparatus 200 is configured to generate a data enable signal DE_OUT which is includes in the display synchronization signal based on the moving-image mode signal MODE_C.

The timing controller 210 is configured to store image data frames DF_N, DF_N+1 and DF_N+2 by a frame unit in the frame buffer 220 in response to the moving-image mode signal MODE_C.

The timing controller 210 is configured to provide the data driver 230 with the image data frames DF_N, DF_N+1 and DF_N+2 using the frame buffer 220 based on the data enable signal DE_OUT of 60 Hz.

For example, the timing controller 210 is configured to provide the data driver 230 with an N-th image data frame DF_N during an M-th frame FM of 60 Hz, and to provide the data driver 230 with the N-th image data frame DF_N stored in the frame buffer 220 during an (M+1)-th frame FM+1 of 60 Hz. The timing controller 210 is configured to provide the data driver 230 with an (N+1)-th image data frame DF_N+1 during an (M+2)-th frame FM+2 of 60 Hz, to provide the data driver 230 with the (N+1)-th image data frame DF_N+1 stored in the frame buffer 220 during an (M+3)-th frame FM+3 of 60 Hz, and to provide the data driver 230 with the (N+1)-th image data frame DF_N+1 stored in the frame buffer 220 during an (M+4)-th frame FM+4 of 60 Hz. The timing controller 210 is further configured to provide the data driver 230 with an (N+2)-th image data frame DF_N+2 stored in the frame buffer 220 during an (M+5)-th frame FM+5 of 60 Hz, and to provide the data driver 230 with the (N+2)-th image data frame DF_N+2 stored in the frame buffer 220 during an (M+6)-th frame FM+6 of 60 Hz According to the comparative example embodiment, the data driver 230 is configured to output the data voltage of the image data frames DF_N, DF_N+1 and DF_N+2 to the data line during all frame periods FM, FM+1, FM+2, FM+3, FM+4, FM+5, and FM+6 (DATAV).

The timing controller 210 is configured to generate a vertical start signal STV which is a gate control signal and to provide the gate driver 250 with vertical start signal STV.

The gate clock generator 240 is configured to generate a gate clock signal CKV based on a data enable signal DE_OUT of 60 Hz and to provide the gate driver 250 with the gate clock signal CKV. According to the comparative example embodiment, the gate clock generator 240 is configured to generate and output the gate clock signal CKV during all frame periods FM, FM+1, FM+2, FM+3, FM+4, FM+5, and FM+6.

Therefore, as shown in FIG. 6, the display apparatus 200 is configured to display a frame image of the N-th image data frame DF_N during the M-th frame FM, to display the frame image of the N-th image data frame DF_N during the (M+1)-th frame FM+1, to display a frame image of the (N+1)-th image data frame DF_N+1 during the (M+2)-th frame FM+2, to display the frame image of the (N+1)-th image data frame DF_N+1 during the (M+3)-th frame FM+3, to display the frame image of the (N+1)-th image data frame DF_N+1 during the (M+4)-th frame FM+4, and to display the frame image of the (N+2)-th image data frame DF_N+2 during the (M+5)-th frame FM+5.

According to the present comparative example embodiment, in the moving image environment, the display apparatus 200 is configured to receive the moving image signal with a driving frequency of 24 Hz from the external graphic device 100 and to display the moving image signal on the display panel 270 with the driving frequency of 60 Hz.

Figure 7:
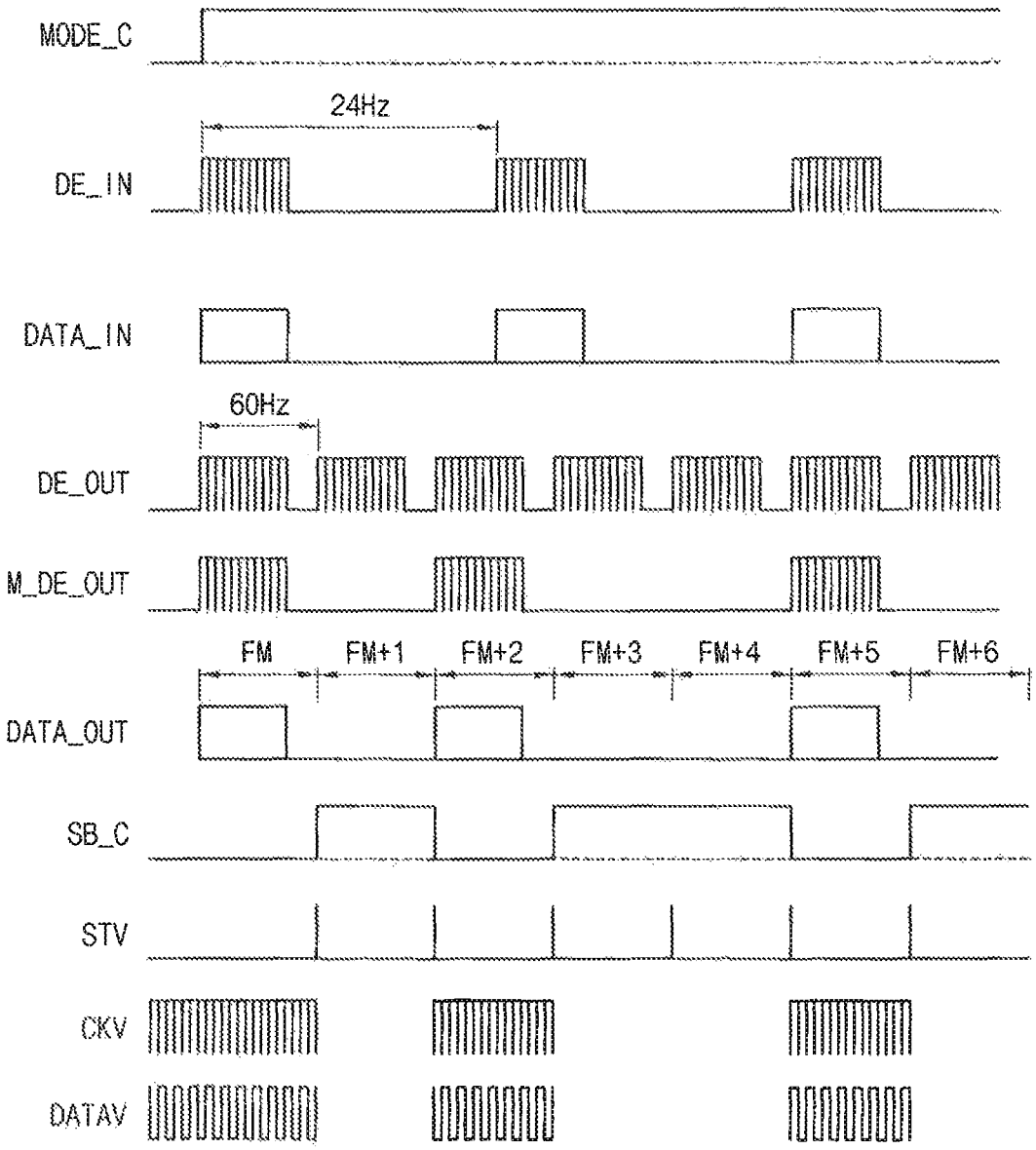
FIG. 7 is a waveform diagram illustrating a method of driving a display apparatus according to an exemplary embodiment of the inventive concept.
Figure 8:
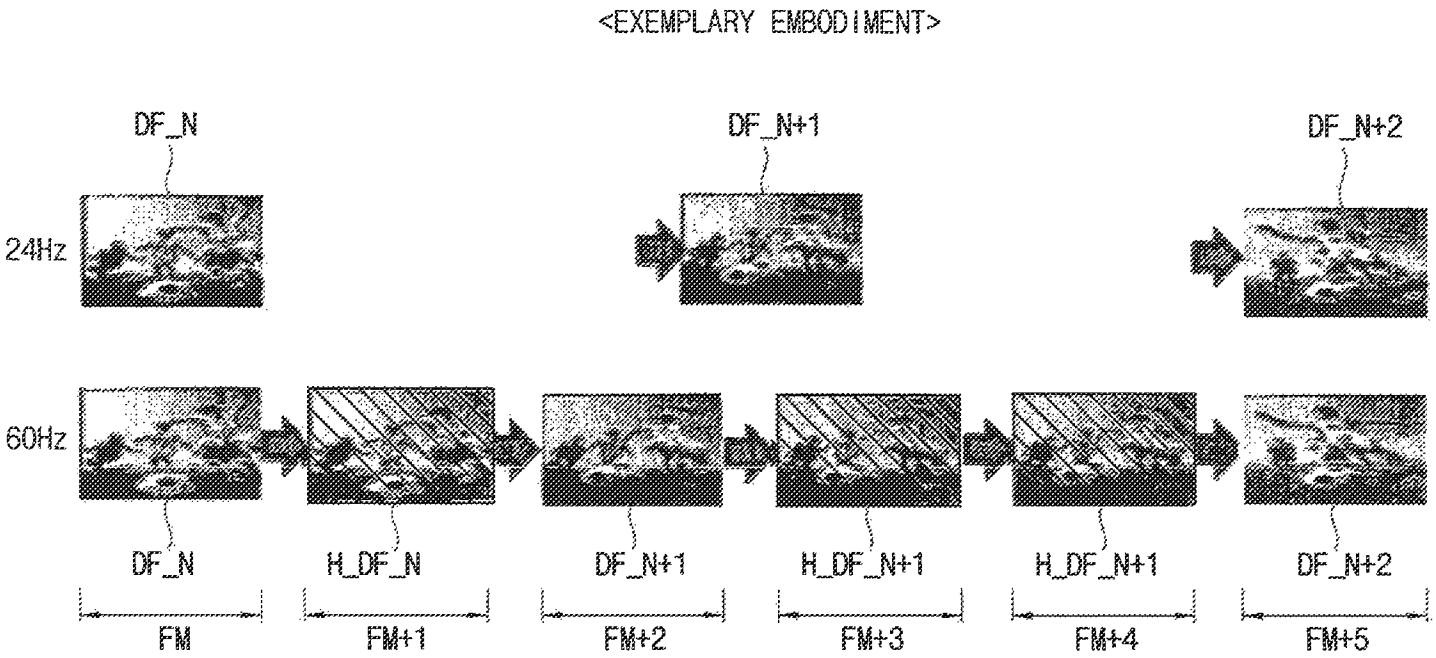
FIG. 8 is a diagram illustrating a method of driving a display apparatus according to an exemplary embodiment of the inventive concept.

FIG. 7 is a waveform diagram illustrating a method of driving a display apparatus according to an exemplary embodiment of the inventive concept. FIG. 8 is a diagram illustrating a method of driving a display apparatus according to an exemplary embodiment of the inventive concept.

Referring to FIGS. 1, 7 and 8, according to the present exemplary embodiment, the external graphic device 100 is configured to transmit image data frames DF_N, DF_N+1, DF_N+2 which are included in a moving image signal having a driving frequency of about 24 Hz to the display apparatus 200 in a moving image environment. The external graphic device 100 is configured to transmit a data enable signal DE_IN and a moving-image mode signal MODE_C which are original synchronization signals having a driving frequency of about 24 Hz.

The timing controller 210 of the display apparatus 200 is configured to generate a data enable signal DE_OUT having a driving frequency of about 60 Hz in response to the moving-image mode signal MODE_C. The timing controller 210 is configured to mask a data enable signal in a preset frame period of the data enable signal DE_OUT of about 60 Hz corresponding to the black data frame BF and to generate a masked data enable signal M_DE_OUT of about 60 Hz. The preset frame period may correspond to a frame period in which each of the image data frames DF_N, DF_N+1 and DF_N+2 is repeated using the frame buffer 220.

The timing controller 210 is configured to generate a standby enable signal SB_C based on the data enable signal DE_OUT and the masked data enable signal M_DE_OUT. The standby enable signal SB_C may have a low level during frame periods in which the image data frames DF_N, DF_N+1 and DF_N+2 are displayed and a high level during preset frame periods in which the image data frames DF_N, DF_N+1 and DF_N+2 are repeated.

The timing controller 210 is configured to store the image data frames DF_N, DF_N+1 and DF_N+2 in the frame buffer 220 by a frame unit in response to the moving-image mode signal MODE_C.

The timing controller 210 is configured to generate a vertical start signal STV which is a gate control signal and to provide the gate driver 250 with the vertical start signal STV.

The gate clock generator 240 is configured to generate a gate clock signal CKV, and to control an output of the gate clock signal CKV in response to the standby enable signal SB_C. The gate clock generator 240 is configured to output the gate clock signal CKV to the gate driver 250 during M-th, (M+2)-th and (M+5)-th frames FM, FM+2 and FM+5 of about 60 Hz in which the standby enable signal SB_C is the low level. However, the gate clock generator 240 is configured not to output the gate clock signal CKV to the gate driver 250 during (M+1)-th, (M+3)-th, (M+4)-th and (M+6)-th frames FM+1, FM+3, FM+4 and FM+6 of about 60 Hz in which the standby enable signal SB_C is at the high level.

The data driver 230 is configured to output the data voltage of the image data frames DF_N, DF_N+1 and DF_N+2 to the data line during the M-th, (M+2)-th and (M+5)-th frames FM, FM+2 and FM+5 of about 60 Hz in which the standby enable signal SB_C is the low level (DATAV). However, the data driver 230 is configured not to output the data voltage to the data line during the (M+1)-th, (M+3)-th, (M+4)-th and (M+6)-th frames FM+1, FM+3, FM+4 and FM+6 of about 60 Hz in which the standby enable signal SB_C is at the high level (DATAV). In other words, the data driver 230 is configured not to be driven during the (M+1)-th, (M+3)-th, (M+4)-th and (M+6)-th frames FM+1, FM+3, FM+4 and FM+6.

The gate driver 250 is configured to generate a gate signal based on the vertical start signal STV and the gate clock signal CKV. The gate driver 250 is configured to output the gate signal to the gate line in response to the low level of the standby enable signal SB_C during the M-th, (M+2)-th and (M+5)-th frames FM, FM+2 and FM+5 of about 60 Hz. However, the gate driver 250 is configured not to output the gate signal to the gate line during the (M+1)-th, (M+3)-th, (M+4)-th and (M+6)-th frames FM+1, FM+3, FM+4 and FM+6 of about 60 Hz. In other words, the gate driver 250 does not receive the gate clock signal CKV in response to the high level of the standby enable signal SB_C during the preset frame period, and thus, is not driven during the preset frame period.

Therefore, as shown in FIG. 8, the display apparatus 200 is configured to display a frame image of the N-th image data frame DF_N during the M-th frame FM and to hold the frame image of the N-th image data frame DF_N during the (M+1)-th frame FM+1. In other words, the frame image of the frame FM remains and is displayed in the next frame FM+1. The display apparatus 200 is configured to display a frame image of the (N+1)-th image data frame DF_N+1 during the (M+2)-th frame FM+2, to hold the frame image of the (N+1)-th image data frame DF_N+1 during the (M+3)-th frame FM+3, and to hold the frame image of the (N+1)-th image data frame DF_N+1 during the (M+4)-th frame FM+4. The display apparatus 200 is further configured to display the frame image of the (N+2)-th image data frame DF_N+2 during the (M+5)-th frame FM+5. According to the present exemplary embodiment, during the (M+1)-th, (M+3)-th, (M+4)-th and (M+6)-th frames FM+1, FM+3, FM+4 and FM+6, the data driver 230 and the gate driver 250 which drive the display panel 270 are not driven, and thus, the display panel 270 holds a previously displayed frame image in a current frame.

Therefore, in the moving image environment, the display apparatus 200 may drive with the standby mode, in which the data driver 230 and the gate driver 250 are not driven, during the preset frame period in which a previous frame image is repetitively displayed.

According to the exemplary embodiments of the inventive concept, power consumption of a display apparatus may be decreased in a moving image environment.

While the inventive concept has been particularly shown and described with reference to exemplary embodiments thereof, it will be apparent to those of ordinary skill in the art that various changes in form and detail may be made thereto without departing from the spirit and scope of the inventive concept as defined by the following claims.

What is claimed is:

1. A display apparatus, comprising:

a display panel comprising a data line and a gate line, wherein the display panel is configured to display an image;

a timing controller configured to generate a display synchronization signal, a masked data enable signal and a standby enable signal during a moving image mode, wherein the display synchronization signal is generated using an original synchronization signal, the masked data enable signal has a first frame period in which a phase is synchronized with a data enable signal and a second frame period in which the data enable signal is masked, the standby enable signal has a first level in the first frame period of the masked data enable signal and a second level different from the first level in the second frame period of the masked data enable signal, and wherein, in the second frame period in which the data enable signal is masked, the data enable signal repeatedly alternates between high and low levels and the masked data enable signal is maintained at a constant level for the entire time the data enable signal repeatedly alternates between the high and low levels;

a data driver configured to provide the data line with a data voltage corresponding to a moving image in response to the display synchronization signal and to block the data voltage from being provided to the data line in response to the second level of the standby enable signal;

a gate clock generator configured to output a gate clock signal in response to the display synchronization signal and to block the gate clock signal from being outputted in response to the second level of the standby enable signal; and a gate driver configured to generate a gate signal in response to the gate clock signal and to output the gate signal to the gate line, wherein the timing controller is configured to receive an image data frame of the moving image and a black data frame, and the preset frame period corresponds to the black data frame, wherein the display apparatus further comprises:

a frame buffer configured to receive the image data frame of the moving image in the moving image mode from the timing controller, wherein the timing controller is configured to generate the standby enable signal based on the data enable signal and the masked data enable signal.

2. The display apparatus of claim 1, wherein a driving frequency of the original synchronization signal is equal to that of the display synchronization signal.

3. The display apparatus of claim 2, wherein the driving frequency of the original synchronization signal is about 48 Hz.

4. The display apparatus of claim 1, wherein a driving frequency of the original synchronization signal is lower than that of the display synchronization signal.

5. The display apparatus of claim 4, wherein a single frame period of the original synchronization signal comprises at least one preset frame period of the display synchronization signal.

6. The display apparatus of claim 4, wherein two sequential frame periods of the original synchronization signal comprises at least three preset frame periods of the display synchronization signal.

7. The display apparatus of claim 4, wherein the driving frequency of the original synchronization signal is about 24 Hz and the driving frequency of display synchronization signal is about 60 Hz.

8. A display apparatus, comprising:

a display panel comprising a data line and a gate line, the display panel configured to display an image with a high driving frequency;

a timing controller configured to receive an image data frame corresponding to a moving image and a black data frame and to generate a display synchronization signal for the image data frame and a standby enable signal for the black data frame in a moving image mode;

a data driver configured to provide the data line with a data voltage corresponding to the image data frame in response to the display synchronization signal and to block the data voltage from being outputted to the data line in response to the standby enable signal;

a gate clock generator configured to output a gate clock signal in response to the display synchronization signal and to block the gate clock signal from being outputted in response to the standby enable signal; and a gate driver configured to generate a gate signal in response to the gate clock signal and to output the gate signal to the gate line, wherein the display apparatus is configured to hold a frame image of the image data frame that was displayed on the display panel in a first frame during a second frame corresponding to the black data frame, wherein a masked data enable signal is maintained at a constant level for the entire time a data enable signal repeatedly alternates between high and low levels when the frame image is held during the second frame, and wherein the timing controller is configured to generate the standby enable signal based on the data enable signal and the masked data enable signal.

9. The display apparatus of claim 8, wherein the standby enable signal has a first level corresponding to the image data frame and a second level corresponding to the black data frame.

10. A method of driving a display apparatus which comprises a data line and a gate line, the method comprising:

generating, at a timing controller, a display synchronization signal using an original synchronization signal in a moving image mode;

generating, at the timing controller, a masked data enable signal and a standby enable signal, wherein the masked data enable signal has a first frame period in which a phase is synchronized with a data enable signal and a second frame period in which the data enable signal is masked, the standby enable signal has a first level in the first frame period of the masked data enable signal and a second level different from the first level in the second frame period of the masked data enable signal, and wherein, in the second frame period in which the data enable signal is masked, the data enable signal repeatedly alternates between high and low levels and the masked data enable signal is maintained at a constant level for the entire time the data enable signal repeatedly alternates between the high and low levels;

blocking a data voltage from being provided to the data line by a data driver in response to the second level of the standby enable signal; and blocking a gate clock signal from being outputted by a gate clock generator in response to the second level of the standby enable signal; and receiving, at a frame buffer, an image data frame corresponding to a moving image and a black data frame, wherein the image data frame and the black data frame are provided from the timing controller, wherein the timing controller is configured to generate the standby enable signal based on the data enable signal and the masked data enable signal.

11. The method of claim 10, wherein a driving frequency of the original synchronization signal is equal to that of the display synchronization signal.

12. The method of claim 11, wherein the driving frequency of the original synchronization signal is about 48 Hz.

13. The method of claim 10, wherein a driving frequency of the original synchronization signal is lower than that of the display synchronization signal.

14. The method of claim 13, wherein a single frame period of the original synchronization signal comprises at least one preset frame period of the display synchronization signal.

15. The method of claim 13, wherein two sequential frame periods of the original synchronization signal comprises at least three preset frame periods of the display synchronization signal.

16. The method of claim 13, wherein the driving frequency of the original synchronization signal is about 24 Hz and the driving frequency of display synchronization signal is about 60 Hz.

17. A method of driving a display apparatus which comprises a data line and a gate line, the method comprising:

receiving, at a timing controller, an image data frame corresponding to a moving image and a black data frame in a moving image mode;

generating, at the timing controller, a standby enable signal during a frame period corresponding to the black data frame;

blocking a data voltage from being provided to the data line in response to the standby enable signal;

blocking a gate clock signal from being outputted in response to the standby enable signal; and holding a frame image of the image data frame that was displayed on the display apparatus in a first frame during a second frame corresponding to the black data frame, wherein a masked data enable signal is maintained at a constant level for the entire time a data enable signal repeatedly alternates between high and low levels when the frame image is held during the second frame, wherein the timing controller is configured to generate the standby enable signal based on the data enable signal and the masked data enable signal.

* * * * *